United States Patent [19]

Ferris et al.

[11] Patent Number: 4,575,094

[45] Date of Patent: Mar. 11, 1986

[54] GAME BOARD HAVING SHIFTABLE BOARD WITH INDICIA THEREON

[75] Inventors: Michael J. Ferris, Chicago; Jeffrey D. Breslow, Highland Park, both of Ill.

[73] Assignee: Marvin Glass & Associates, Chicago, Ill.

[21] Appl. No.: 578,192

[22] Filed: Feb. 8, 1984

[51] Int. Cl.[4] ..... A03F 3/00

[52] U.S. Cl. ..... 273/249; 273/282; 273/287; 273/288

[58] Field of Search ..... 273/280, 281, 282, 283, 273/284, 287, 153 S, 243, 271, 263, 264

[56] References Cited

U.S. PATENT DOCUMENTS

| | | | |
|---|---|---|---|
| 2,408,270 | 9/1946 | Rebholz | 273/271 |
| 3,762,714 | 10/1973 | Wilson | 273/280 |
| 4,002,342 | 1/1977 | Biggs | 273/280 |
| 4,228,596 | 10/1980 | Daniel | 273/271 X |
| 4,234,185 | 11/1980 | Alsip | 273/243 |
| 4,334,680 | 6/1982 | Liversidge | 273/287 |

*Primary Examiner*—Richard C. Pinkham
*Assistant Examiner*—Matthew L. Schneider
*Attorney, Agent, or Firm*—John S. Pacocha

[57] ABSTRACT

A board game including a base board and an upper board shiftable within limits atop the base board in either of two transverse directions. The base board bearing sets of danger, safe, and return indicators and the upper board has graphics of a pathway through a castle. Openings along the pathway extend through the upper board to expose some of the danger and return indicators. Each player is provided with a marker movable from opening to opening plus shift board, obstacle/peril, and defense/escape cards, the obstacle/peril cards being playable on an opponent whose token is on a danger indicator. Failure to defend against or escape a peril or obstacle causes the player to return to the last exposed return spot.

20 Claims, 5 Drawing Figures

GAME BOARD HAVING SHIFTABLE BOARD WITH INDICIA THEREON

BACKGROUND OF THE INVENTION

1. Field of the Invention

This invention relates generally to board games and more particularly to board games that embody a theme suggested by other media or events.

2. Background Art

Board games, particularly those based on various themes suggested by real life events or occurrences, or by other games, have long been popular. For example, prior art patents assigned to the assignee of the present invention disclose board games embodying the themes of: a beauty contest, U.S. Pat. No. 3,861,686; ;l investment, U.S. Pat. No. 3,865,379; invention, U.S. Pat. No. 3,885,792; golf, U.S. Pat. No. 3,989,249; magic acts, U.S. Pat. No. 3,989,251; fast food franchises, U.S. Pat. No. 3,994,499; and the legendary creature "BIG FOOT", U.S. Pat. No. 4,128,246. The rescue of a princess by a daring knight has provided the basis for much entertainment. Recently the StarCom "DRAGON'S LAIR" video game wherein a knight enters a castle to rescue a princess and must overcome various obstacles and perils in the attempt has become a popular arcade game. There are currently board games based on the Bally/-Midway "PAC-MAN", Nintendo "DONKEY KONG", and Sega "FROGGER" video games. However, there remains a need for additional partable board games that provide entertaining, challenging and competitive play of a game employing a theme suggested by a popular video game. Moreover, there is a need for a board game which can mechanically simulate the sudden interposition of obstacles and perils in the path of a player moving toward a goal as occurs in the "DRAGON'S LAIR" video game.

SUMMARY OF THE INVENTION

The present invention is concerned with providing a portable board game for competitive play that employs the theme of the StarCom "DRAGON'S LAIR" video game and provides a mechanical shifting of the path being followed by the player to interpose obstacles and perils. These and other objects and advantages of the invention are achieved by a board game having an underlying base board bearing sets of safe, danger and return indicators. An upper board is shiftable within limits atop the base board and has a number of openings defining spaces along the path to be followed by the players. Each of the openings exposes one of the indicators within each set on the underlying base board. Both a die and cards provide opportunities for shifting the upper board. Whenever the board is shifted each player's marker which fits within an opening is carried onto another indicator within the set which may suddenly expose a player on a safe space to danger. Each player is provided with a number of cards from a deck containing various danger and defense/escape cards as well as shift cards. Whenever a player is in danger every other player having an obstacle or peril card may play the card on the player in danger. Unless the attacked player has an appropriate defense/escape card, the player then drops back to the last exposed return spot.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
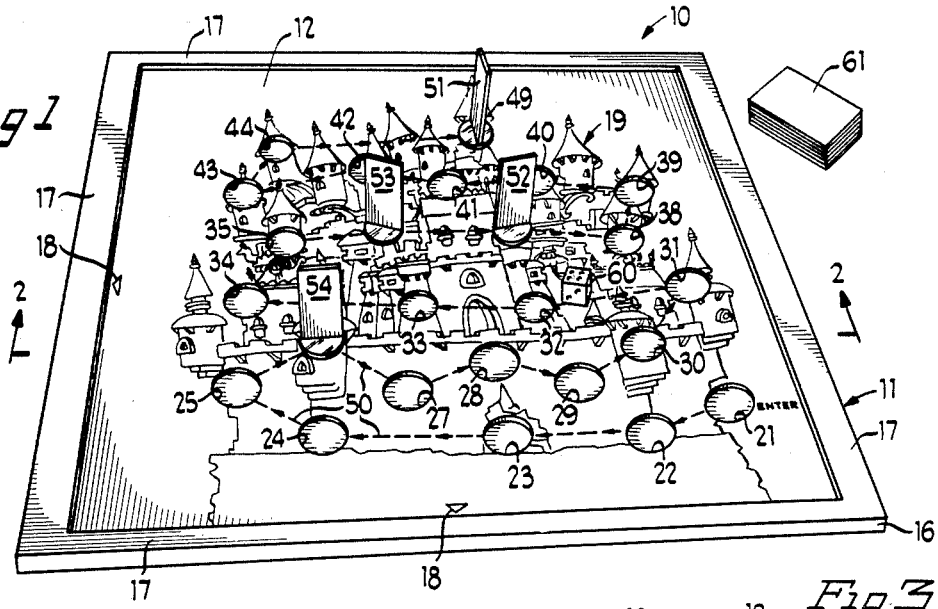
FIG. 1 is a perspective view of an embodiment of the present invention in the course of play.

Referring now to the drawing in which like parts are designated by like reference characters throughout the several views, there is shown in FIG. 1 a board game 10 for two to four players which includes an underlying stationary base board 11 and an upper laterally shiftable board 12.

Base board 11 has a square bottom 14 with a generally planar player facing surface 15 and short vertical side walls 16 extending upwardly from the outer perimeter. A top border 17 is spaced from the bottom 14 and extends inwardly the same distance from each side wall 16 defining a smaller concentric square than that defined by the inside perimeter of walls 16. The space between the bottom 14 and the border 17 is greater than, but preferably not more than twice, the thickness of the upper shiftable board 12.

The perimeter of the upper shiftable board 12 forms a square that is smaller than the square defined within side walls 16 but larger than the square defined by the inwardly extending borders 17. Accordingly, board 12 is laterally shiftable, generally parallel to the playing surface 15, along the inside of any side wall a distance equal to the difference between the length of a side of the board 12 and the distance between two opposed walls 16. Board 12 may be shifted from the one position shown in FIGS. 1 and 3 along either of the transverse walls 16 that it abuts to one of two other positions, or to a fourth position abutting the opposite pair of transverse vertical walls. Since the inside edges of the border 17 would overlap the board 12, even if the shiftable board were centered, board 12 is captured and precluded from substantial movement perpendicular to the playing surface 15.

In the absence of any restraining structure, the board 12 could be shifted in a direction other than parallel to a wall 16. However, an outwardly directed arrow head 18 in approximately the center of each of the four sides indicates the directions the board may be shifted. As is best shown in FIG. 1, whenever the board 12 is in one of its four positions, two of the arrow heads are obscured from the players' view by the overlying border 17.

Shiftable board 12 is provided with a graphic representation of a castle 19 and has a series of circular openings 21–45, all of the same size, defining a circuitous path from adjacent one lower side of the castle 19 to an upper tower 49. Arrows 50 indicate the direction of advance from space 21 to space 45. All of the spaces 21–45 extend through to the player facing surface 15 on the underlying base board 11.

Each player is provided with a marker 51, 52, 53, or 54. The markers all have a circular disk or pedestal 55 preferably made of a clear plastic. The pedestal 55 supports a vertically disposed card or piece of plastic bearing identifying indicia, such as a knight of a particular design or color, to distinguish one marker from another. In addition, each disk 55 fits into any one of the openings 21–45.

Advancement of a player's marker from one space to another is determined by the roll of die 60. Two of the die faces bear an indication to shift the board and move the marker one space while the other four faces bear an indication to move the marker two, three, four or five spaces. Game 10 also includes a deck of thirty-five cards 61 divided into seven each of a shift board card 62, a sword card 63, a peril card 64 requiring a sword card for defense, an obstacle card 65 requiring a jump card to escape, and a jump card 66.

Figure 4:
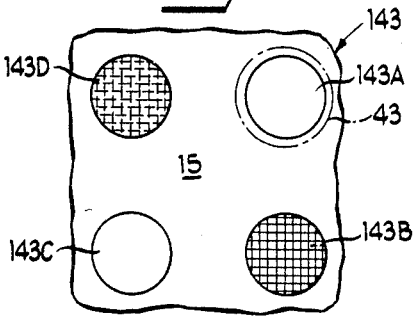
FIG. 4 is an enlarged scale, fragmentary top plan view.

Underlying each of the open spaces 21–45 is a corresponding set of four play or path condition indicator circles arranged in a square. FIG. 4 shows the fragment of player facing surface 15 containing the set 143 for space 43 which is shown in phantom. The distance from the center of any one indicator along any side of the set square to the center of another indicator in the same set is equal to the distance that the upper shiftable board may be moved.

There are three different game condition indicators. A clear or safe condition is indicated by a white circle such as 143A and 143C. The danger condition is indicated by a black circle such as 143B while the space to which an unsuccessful player must return is identified by a yellow circle indicator like 143D. Each set of indicators will be a combination of one, two or all three of the safe, danger and return indicators.

Figure 3:
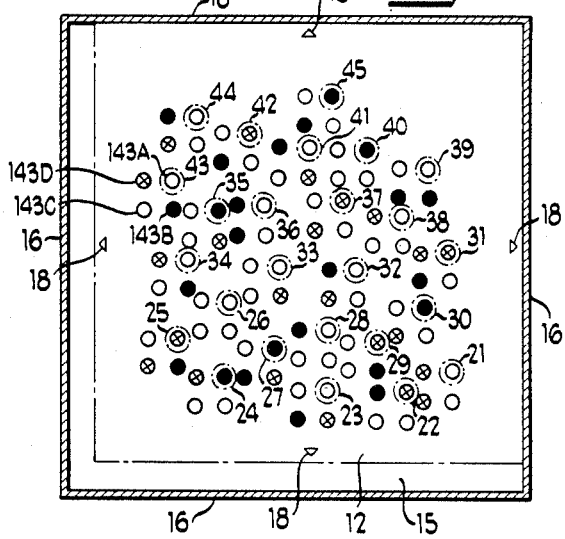
FIG. 3 is a reduced scale, sectional view taken generally along line 3—3 of FIG. 2.
Figure 2:
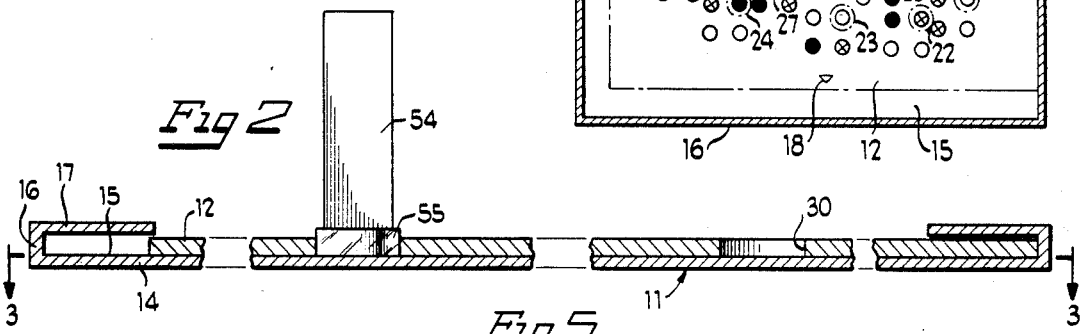
FIG. 2 is an enlarged scale, sectional view taken generally along line 2—2 of FIG. 1.
Figure 5:
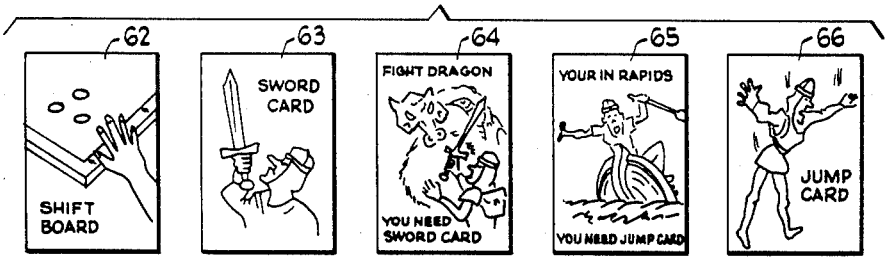
FIG. 5 is a top plan view of the faces of the cards.

In FIG. 3 the upper shiftable board is shown in phantom to illustrate how each of the openings 21–45 register with the corresponding play or path condition indicator sets on the player playing surface 15 of base board 11. Generally, the sets will differ from each other although there will be some duplication such as the indicator set for opening 34 being the same as set 143. For convenience of illustration, the indicator sets in FIG. 3 have not been numbered and the return indicator is merely designated by an "X" within the circle rather than being lined for the color yellow as in FIG. 4. The graphics of the game could be enhanced by including a representation of a princess in the two indicator circles shown as safe or clear in FIG. 3.

For the pattern of indicator sets illustrated in FIG. 3, with the upper shiftable board in the position shown in FIGS. 1 and 3, a player would proceed safely from space 21 up to space 23. However, if the player landed on space 24 under which the danger indicator is exposed, the player may have to go back to the last exposed return space 22. When the board 12 is shifted down, exposing danger indicator 143B in space 43, a player starting at the entry space 21 would first encounter danger at space 25.

Of course, the pattern of the indicators within each set could be modified from that shown in FIG. 3. It might also be desirable to make the indicator circles all larger than the size of the openings 21–45. In addition, since the safe or clear indicator is used more often than either the danger or return indicator, the safe condition may conveniently be indicated merely by the upwardly facing surface 15 of the base board.

During the course of play the various players may all be on a space indicated to be a return or safe when the next player rolls a shift the board indication on the die. The die rolling player then has the option of shifting the board into one of the two available positions. By rule, shifting the board is limited to a single move along one of the abutting vertical walls. That is, it is not permitted to shift the board to the diagonally opposed position which would be considered as a double shift move. Once the player shifts the board carrying all of the player's markers onto a different indicator of the set, the condition of each player's marker may be changed and any such change is observable through the clear plastic disk. Thus, for example, if a player's marker were in the opening 24 as shown in FIGS. 1 and 3, and the board was shifted downwardly that player would then be in danger.

Each player is provided with three cards from the deck 61 at the onset of the game and replaces each card as it is played by blindly picking from the deck 61. When a player is in danger each opponent having a peril or obstacle card 64 or 65 may play such a card on the player in danger and that player must then respond with an appropriate defense or escape card. As an alternative, the player in danger may play a shift board card 62 in an attempt to move the player's own marker to a safe or return condition indicator. Failing to defend against or escape the danger, the player must drop back to the last exposed return space. While designating the space to which a player must drop back, the return play condition has the same effect as the safe or clear condition when a player lands on it during forward movement or as a result of a shift of the board.

The last space 45 in the uppermost tower 49 of the castle conveniently contains two danger indicators and two safe or princess (not shown) indicators. There is no need for a return indicator in the last space. If a player lands on space 45 with the safe condition showing, the player is deemed to have sucessfully rescued the princess and won the game.

While a particular embodiment of the present invention has been shown and described with some alternatives, other changes and modifications will occur to those skilled in the art. It is intended in the following claims to cover all such changes and modifications as fall within the true spirit and scope of the present invention.

What is claimed as new and desired to be secured by Letters Patent is:

1. A board game comprising:

markers for a plurality of players;

a base board having a substantially planar player facing surface;

a laterally shiftable board overlying the player facing surface and being selectively movable substantially parallel to the player facing surface into each of at least two positions;

the shiftable board being laterally moveable in either of two substantially transverse directions;

viewing means at spaced intervals on the shiftable board defining a path for movement of the player markers and permitting portions of the player facing surface of the underlying board to be viewed by the player;

first means on the player facing surface of the base board indicating a first condition of play exposed to the player through some of the viewing means on the shiftable board when the shiftable board is in each of the positions; and second means on the player facing surface of the base board indicating a second condition of play exposed to the player through some of the viewing means on the shiftable board when the shiftable board is in each of the positions.

2. The board game of claim 1 including third means on the player facing surface of the base board indicating a third condition of play exposed to the player through some of the viewing means on the shiftable board when the shiftable board is in each of the positions.

3. The board game of claim 1 in which one of the means indicating a condition of play is the player facing surface itself.

4. The board game of claim 1 in which the shiftable board is selectively movable into each of four positions.

5. The board game of claim 1 including means precluding substantial movement of the shiftable board perpendicular to the player facing surface.

6. The board game of claim 5 in which the shiftable board is of a predetermined thickness and the means precluding substantial movement of the shiftable board perpendicular to the player facing surface includes a border extending inwardly from the periphery of the base board and spaced from the base board a distance sufficient to receive the thickness of the shiftable board.

7. The board game of claim 6 in which:

the base board has a first inside periphery;

the inward extension of the border defines a second inside periphery; and the shiftable board has an outer periphery that is less than the first inside periphery and greater than the second inside periphery.

8. The board game of claim 6 in which:

the base board is a regular polygon of a predetermined size;

the shiftable board forms a similar regular polygon that is smaller relative to the base board; and the inwardly extending border defines a similar regular polygon that is smaller relative to the shiftable board.

9. The board game of claim 8 in which the polygon is a square.

10. The board game of claim 1 in which the viewing means are openings in the shiftable board.

11. The board game of claim 10 in which the player markers fit into each of the openings and are supported upon the player facing surface of the base board.

12. The board game of claim 11 in which the markers are carried from one position to another by the shiftable board.

13. The board game of claim 1 in which the base board includes sidewalls extending transverse to the playing surface and limiting the lateral moveability of the shiftable board.

14. The board game of claim 1 in which:

the base board is a regular polygon of a predetermined size; and the shiftable board is a similar regular polygon that is smaller relative to the base board.

15. The board game of claim 14 in which the polygon is a square.

16. The board game of claim 1 in which the means for indicating a condition of play are arranged in sets of four.

17. The board game of claim 16 in which the means for indicating a condition of play are arranged in a square.

18. A board game comprising:

markers for a plurality of players;

a base board having a substantially planar player facing surface;

a shiftable board overlying the player facing surface and being selectively movable substantially parallel to the player facing surface into each of at least two positions;

openings in the shiftable board at spaced intervals defining a path for movement of the player markers and permitting portions of the player facing surface of the underlying board to be viewed by the player;

first means on the player facing surface of the base board indicating a first condition of play exposed to the player through some of the openings in the shiftable board when the shiftable board is in each of the positions;

second means on the player facing surface of the base board indicating a second condition of play exposed to the player through some of the openings in the shiftable board when the shiftable board is in each of the positions;

the player markers fitting into each of the openings and being supported upon the player facing surface of the base board; and the markers each having a pedestal of transparent material that fits into the openings.

19. The board game of claim 18 in which the shiftable board is laterally moveable in either of two substantially transverse directions.

20. The board game of claim 19 in which the base board includes sidewalls extending transverse to the playing surface and limiting the lateral moveability of the shiftable board.

* * * * *